US008555542B2

(12) United States Patent
Ziegler

(10) Patent No.: US 8,555,542 B2
(45) Date of Patent: Oct. 15, 2013

(54) SIGHTING TELESCOPE MOUNTING SYSTEM

(76) Inventor: Gerhard Ziegler, Georgensgmünd (DE)

( * ) Notice: Subject to any disclaimer, the term of this patent is extended or adjusted under 35 U.S.C. 154(b) by 212 days.

(21) Appl. No.: 12/970,367

(22) Filed: Apr. 6, 2011

(65) Prior Publication Data

US 2011/0197490 A1 Aug. 18, 2011

(30) Foreign Application Priority Data

Dec. 22, 2009 (DE) ..... 10 2009 060 659
Jan. 22, 2010 (DE) ..... 10 2010 005 589

(51) Int. Cl.
*F41G 1/00* (2006.01)

(52) U.S. Cl.
USPC ..... 42/124; 42/126; 42/127; 42/148

(58) Field of Classification Search
USPC ..... 42/124–128, 148
See application file for complete search history.

(56) References Cited

U.S. PATENT DOCUMENTS 1,117,782 A * 11/1914 Camus ..... 42/125
1,418,935 A * 6/1922 Knoble ..... 42/126
1,622,193 A * 3/1927 Fischer ..... 42/136
1,710,547 A * 4/1929 Meise ..... 42/124
1,816,195 A * 7/1931 Redfield ..... 42/127
1,837,290 A * 12/1931 Redfield ..... 42/127
1,905,070 A * 4/1933 Steinle ..... 42/124
2,036,290 A * 4/1936 McCann ..... 42/124
2,135,774 A * 11/1938 Tilden ..... 42/126
2,306,972 A * 12/1942 Meisel ..... 42/125
2,396,404 A * 3/1946 Williams et al. ..... 42/125
2,445,595 A * 7/1948 Bengert ..... 42/125
2,450,466 A * 10/1948 Richard ..... 42/127
2,452,145 A * 10/1948 Pike ..... 42/127
2,475,383 A * 7/1949 Foster ..... 42/16
2,493,254 A * 1/1950 Marcus ..... 42/126
2,510,289 A * 6/1950 Livermore ..... 42/125
2,526,816 A * 10/1950 Hardgrove ..... 42/127
2,580,246 A * 12/1951 Schall ..... 42/127
2,585,985 A * 2/1952 Anderson ..... 42/127
2,620,565 A * 12/1952 Boughton ..... 42/126
2,641,057 A * 6/1953 Moore ..... 42/127
2,836,895 A * 6/1958 Dillon ..... 42/127

(Continued)

FOREIGN PATENT DOCUMENTS

DE 15 78 319 A1 11/1971
DE 75 24 622 U 2/1976

(Continued)

*Primary Examiner* — Michelle Clement
(74) *Attorney, Agent, or Firm* — Lucas & Mercanti, LLP

(57) ABSTRACT

A sighting telescope mounting system for a firearm. The firearm and/or the telescope in the desired position are aligned in an axial direction, with a pivot foot attached to the telescope and with a pivot holding device affixed to the firearm. The pivot foot and pivot holding device jointly form a pivot joint, which enables a pivot of the sighting telescope by a pivot angle around a pivot range, on a plane which is formed by the telescope and the axial direction of the firearm. A connection surface is arranged on the pivot holding device and a clamping surface is arranged on the pivot foot and forms a contact area with the connection surface so that the pivot foot is axially affixed. In the desired position, the contact area is arranged at a distance from an edge of the connection surface in a radial alignment and/or towards the telescope.

17 Claims, 6 Drawing Sheets

(56) References Cited

U.S. PATENT DOCUMENTS

| | | | | | |
|---|---|---|---|---|---|
| 2,931,101 | A * | 4/1960 | Hermann | 42/127 |
| 2,937,448 | A * | 5/1960 | Dimick | 42/126 |
| 2,942,346 | A * | 6/1960 | Heinrich | 42/127 |
| 3,205,579 | A * | 9/1965 | Plisk | 42/127 |
| 3,259,986 | A * | 7/1966 | Carr | 42/124 |
| 3,463,430 | A * | 8/1969 | Jimenez et al. | 42/124 |
| 3,750,318 | A * | 8/1973 | Burris | 42/127 |
| 3,785,603 | A * | 1/1974 | Apel | 248/222.13 |
| 3,877,166 | A * | 4/1975 | Ward | 42/127 |
| 3,880,389 | A * | 4/1975 | Burris | 248/205.1 |
| 4,121,363 | A * | 10/1978 | York | 42/127 |
| 4,205,473 | A * | 6/1980 | Wilson | 42/127 |
| 4,249,315 | A * | 2/1981 | Hopson, III | 42/125 |
| 4,291,476 | A * | 9/1981 | Repa | 42/124 |
| 4,310,980 | A * | 1/1982 | Pilkington | 42/127 |
| 4,353,180 | A * | 10/1982 | Wilson | 42/127 |
| 4,934,085 | A * | 6/1990 | Lough | 42/127 |
| 4,959,908 | A * | 10/1990 | Weyrauch | 42/124 |
| 5,035,487 | A * | 7/1991 | Herz | 359/896 |
| 5,070,637 | A * | 12/1991 | French | 42/122 |
| 5,111,587 | A * | 5/1992 | Plank | 42/127 |
| 5,274,941 | A * | 1/1994 | Moore | 42/126 |
| 5,390,419 | A * | 2/1995 | Sirkis | 42/127 |
| 5,396,725 | A * | 3/1995 | Talbot | 42/127 |
| 5,400,539 | A * | 3/1995 | Moore | 42/127 |
| 5,680,725 | A * | 10/1997 | Bell | 42/127 |
| 5,787,630 | A * | 8/1998 | Martel | 42/125 |
| 6,594,938 | B2 * | 7/2003 | Horton | 42/127 |
| 6,922,934 | B1 * | 8/2005 | Huan | 42/127 |
| 7,140,143 | B1 * | 11/2006 | Ivey | 42/125 |
| 7,308,772 | B1 * | 12/2007 | Millett | 42/127 |
| 7,543,405 | B1 * | 6/2009 | Ivey | 42/125 |
| 7,562,485 | B2 * | 7/2009 | Newhall et al. | 42/127 |
| 7,827,724 | B1 * | 11/2010 | Spinelli | 42/124 |
| 7,908,782 | B1 * | 3/2011 | LaRue | 42/128 |
| 7,971,384 | B2 * | 7/2011 | Lippard | 42/124 |
| 8,079,171 | B2 * | 12/2011 | Barrett | 42/125 |
| 8,136,287 | B2 * | 3/2012 | Adams | 42/124 |
| 2003/0056417 | A1 | 3/2003 | Horton | |
| 2008/0034638 | A1 * | 2/2008 | Spuhr | 42/127 |
| 2008/0092421 | A1 * | 4/2008 | Beckmann | 42/90 |
| 2010/0175299 | A1 * | 7/2010 | Lippard | 42/124 |
| 2010/0263256 | A1 * | 10/2010 | Spinelli | 42/124 |
| 2011/0061286 | A1 * | 3/2011 | Wang | 42/125 |

FOREIGN PATENT DOCUMENTS

| | | | |
|---|---|---|---|
| DE | 3204152 | A1 | 8/1983 |
| DE | 94 06 408 | U1 | 7/1994 |
| DE | 9406408 | | 7/1994 |
| DE | 298 02 854 | U1 | 8/1998 |
| DE | 29802854 | | 8/1998 |
| DE | 20 2006 004 542 | U1 | 6/2006 |
| DE | 10 2005 005 232 | A1 | 8/2006 |
| DE | 102005005232 | | 8/2006 |
| GB | 853 182 | A | 11/1960 |
| WO | 9315371 | A1 | 8/1993 |

* cited by examiner

SIGHTING TELESCOPE MOUNTING SYSTEM

The present application claims priority of DE 10 2009 060 659.9, filed Dec. 22, 2009, and DE 10 2010 005 589.1 filed Jan. 22, 2010, and these applications are incorporated herein by reference.

BACKGROUND OF THE INVENTION

The invention relates to a sighting telescope mounting system for a firearm for mounting a sighting telescope on the firearm in a desired position, wherein the firearm and/or the sighting telescope in the desired position are aligned in an axial direction, with a pivot foot which can be attached to the sighting telescope, and with a pivot holding device which can be affixed to the firearm, wherein the pivot foot and pivot holding device jointly form a pivot joint, which during mounting enables the sighting telescope to be pivoted by a pivot angle around a pivot range on a plane which is formed by the sighting telescope and the axial direction of the firearm, with a connection surface which is arranged on the pivot holding device and with a clamping surface which is arranged on the pivot foot, and which when mounted forms a contact area with the connection surface, so that the pivot foot is affixed in the axial direction, and is in particular clamped.

Sighting telescopes are frequently used for firearms, particularly weapons, which are designed as a telescope with a sighting mechanism which is integrated in the optics. The sighting mechanism and the firearm must be adjusted (zeroed in) in order to ensure that with the sighting mechanism, the sight is focused on a real penetration point of a projectile fired using the firearm.

In practise, however, it is sometimes necessary to separate the sighting telescope and the firearm from each other. This necessity can arise for example during transportation or storage. In order to be able to attain a reproducible mounting of the sighting telescope on the firearm after removal without renewed zeroing in, sighting telescope mounting systems are used which enable a simple separation and re-mounting of the sighting telescope on the firearm in the zeroed in position.

At least two different types of sighting telescope mounting systems are known for hunting weapons:

For example, document DE 9406408 relates to a mounting system for a "pivot rotary mounting" of a sighting telescope, wherein a front centre pin of the mounting system is inserted into a front base of a firearm and the sighting telescope is pivoted by 90°. A rear pin is inserted into a side notch during the pivot movement and is locked in place using a hand lever. A similar mounting system is also disclosed in document DE 10 2005 005232 A1.

A highly traditional type of mounting is the "Suhler claw mount" (SEM). With the Suhler claw mount, the mounting foot which is attached to the lens head of the sighting telescope is hooked into a front base plate on the firearm. After being pressed down briefly and firmly, the rear mounting foot which is affixed on the central tube of the sighting telescope latches into a rear mounting plate. In order to again remove the sighting telescope, a springed slide which is attached to the rear base plate must be drawn back as a result of which the lock on the rear foot is released and the sighting telescope can be unhooked. The Suhler claw mount is regarded as being one of the most expensive sighting telescope mounting systems since it requires highly complex fitting work. Each individual fitting surface must be reworked separately and manually in order to provide a precise seat for the sighting telescope in a desired position. Reference is made to the Suhler claw mount in document DE 29802854 U1, for example, which is assumed to be the closest prior art as a result.

SUMMARY OF THE INVENTION

The object of the invention is to create a sighting telescope mounting system which provides position reproducibility of the sighting telescope and the firearm, even following multiple assembly and removal procedures.

This object is attained by means of a sighting telescope mounting system with the features described in the present invention. Preferred or advantageous embodiments of the invention are included in the subclaims, the description below and the appended figures.

This object is attained by means of a sighting telescope mounting system with the features described in claim 1. Preferred or advantageous embodiments of the invention are included in the subclaims, the description below and the appended figures.

Within the scope of the invention, a sighting telescope mounting system for a firearm, in particular for a hunting and/or sporting weapon, is recommended which is designed for mounting a sighting telescope on the firearm. The sighting telescope can be designed as an optical telescope, although a design as any other mapping device required is also possible.

The sighting telescope mounting system is created in such a manner that the telescope can be mounted in a desired position, wherein the desired position describes the position in which the sighting telescope captures at a certain distance a penetration point of a projectile shot from the firearm. In particular, the desired position is to be regarded as that position which according to specialists in the field is determined by zeroing in. For the purpose of the description, the alignment of the firearm and/or the sighting telescope will be referred to below as the axial direction; in the description, a radial direction is relative to said axial direction.

The sighting telescope mounting system preferably builds on the claw mount or counter-claw mount, wherein a front or a rear foot of the sighting telescope mounting system—referred to below as the pivot foot—can be hooked into a pivot holding device which can be affixed and/or is affixed to the firearm. A vice-versa design is also feasible within the scope of the invention, wherein the pivot foot can be attached to the firearm and the pivot holding device can be attached to the sighting telescope. The pivot foot and the pivot holding device together form a pivot joint when hooked in, wherein during mounting, the sighting telescope is pivoted in numerical terms by a pivot angle and in terms of its position by a pivot area. A further foot—also known as the arresting foot—is affixed on a further holding device on the firearm.

The pivot plane is defined by the alignment of the sighting telescope and the alignment of the firearm, wherein in a projection direction, the firearm and the sighting telescope are always congruent during mounting. Thus far, the sighting telescope mounting system is similar to the known Suhler claw mount.

If the pivot holding device is inspected somewhat more closely, it shows a connection surface which is roughly aligned in the radial direction, but which in particular can also be curved and/or angled etc. The pivot foot comprises a clamping surface which is similarly aligned, and which when mounted forms a contact area with the connection surface, so that the pivot foot is affixed, and in particular, clamped in the axial direction. In particular, the contact area prevents the sighting telescope mounting system from being displaced in the direction of the arresting foot. The contact area thus forms a form-fit and/or a fixed bearing for the sighting telescope mounting system in the axial direction as well as the direction of travel, in the direction of the arresting foot.

It is recommended according to the invention that in the desired position, the contact area is arranged in a radial alignment and/or at a distance from an edge of the connection surface in the direction facing the sighting telescope. The connection surface thus extends further in the radial alignment than the contact area, so that the contact area is positioned in an inner area of the connection surface.

This structural modification establishes the basis for two possible technical improvements:

On the one hand, the load on the edge area of the connection surface is decreased. Due to the decrease in the load on the edge area, it is possible to significantly increase the number of assembly and removal procedures without subsequently correcting the sighting telescope mounting system. While with the Suhler claw mount, only 10 to 20 changes were usually possible, experiments have shown that with the sighting telescope mounting system according to the invention, more than 100, even over 200 changes can be conducted without subsequently correcting the contact area. The maintenance intervals for the sighting telescope mounting system are thus drastically increased compared to the original Suhler claw mount.

A second technological effect is that when a small change is made to the pivot angle, for example when folded out from the desired position by up to +/−1° or by up to +3°, the contact area remains at a distance from the edge of the connection surface, so that a tolerance is provided with regard to the pivot angle. The pivot angle is affixed at the desired position using the other foot, wherein however an overdefinition of the pivot angle—as has frequently been standard practise with the Suhler claw mount—is no longer given.

The contact area can be designed as a line contact or as a contact point. Naturally, these are idealised assumptions; due to the Hertzian stress, these basic geometric forms are usually broadened or converted into compressed ellipses. It is also feasible that the pivot foot is attachable and/or attached to the firearm and the pivot holding device is attachable and/or attached to the sighting telescope.

In terms of the structure, the distance according to the invention can be recognised e.g. by the fact that in the desired position between the connection surface and the clamping surface, starting from the contact area, a gap or comma gap or a gap with unparallel walls is provided which opens outwards in the radial direction. In a longitudinal section through or parallel to the axial extension, the gap width increases in the radial direction in a monotone manner or even in a severely monotone manner. In particular, the gap width changes continuously.

In order to generate the gap, it can be provided that in the named longitudinal section, the connection surface and/or the clamping surface is curved. Different options are possible here: On the one hand, the connection surface can be curved and the clamping surface can be convex, or vice-versa. Instead of a straight extension, a surface can also have a further convex curve, so that two convex surfaces abut each other. Even a concave curve with a convex curve can be used, which are selected in such a way however that the gap which opens is formed outwards in the radial direction. The type of curve can correspond to a pitch circle, a parabola or any free form required.

With one preferred embodiment of the invention, clamping means are provided which are designed to apply a clamping force onto the pivot foot in the axial direction, so that the pivot foot is held in a clamp in the pivot holding device. Due to the clamping means, the pivot foot is pre-tension in the axial direction in the pivot holding device. The clamping means can be arranged in the pivot foot and/or in the pivot holding device.

With a further development of the invention, it is provided that the pivot force is constant or almost constant in a pivot angle range which is e.g. less than 5° around the desired position, in particular solely in the swing open direction. With this further development, it is again emphasised that the affixation of the pivot foot in the axial direction is independent or almost independent of small changes to the pivot angle from the desired position, or if appropriate, from small changes to the position of the contact area on the connection surface. It is particularly preferred when the sighting telescope is tensioned in a self-retaining manner by the mounting system in several positions in the pivot angle range around the desired position. With one preferred embodiment, the pivot foot is arranged in the pivot holding device in an impact-free manner with regard to the pivot angle.

The following options are available, among others, when selecting the pivot area:

On the one hand, a support point or support area of the pivot foot can form the pivot area on the pivot holding device. The support point or area can be arranged on an outer side which faces away from the sighting telescope, or on an inner side of the pivot holding device which faces away from it. It is also feasible for the support point or support area to be arranged on a base of the pivot holding device.

With one structural realisation of the invention, it is provided that the pivot holding device is designed as a mounting plate, which can preferably be inserted into a dovetail guide in the firearm.

It is also preferred that the pivot foot comprises a hook section which enables a claw mount into the pivot holding device. This feature in particular again shows the similarity with the famous Suhler claw mount.

With a further development of the invention, the pivot foot comprises at least one or more, and preferably precisely two, hook sections, which are preferably arranged at a distance from each other. In this design, the pivot foot according to the invention is highly similar to the classic pivot foot. The use of two hook sections supports a tilt-free mounting of the sighting telescope mounting system. It should be noted that the hook section(s) form part of the pivot joint, and thus have a dual function. Preferably, the hook sections are opened to the side which faces away from the other foot.

With one possible design of the invention, the pivot foot and/or the pivot holding device comprise a circle segment contour in the longitudinal section, which forms a part of the pivot joint. In this case, it is preferred that the pivot area of the pivot joint be arranged in the central point of the circle segment. It is feasible that the pivot holding device comprises a convex circle segment which is formed by a pin, for example, and on which the hook section of the pivot foot rests or hooks in. On the other hand, it can also be provided that the pivot foot comprise in the longitudinal section a convex circle section contour with which the pivot foot rests in a matching holding contour of the pivot holding device. In both cases, it can be provided that the holding contour is designed to be elastically compliant with regard to its opening angle, so that clamping means are thus formed.

With a particularly preferred embodiment of the invention, the pivot foot has a holding bracket in the longitudinal section, which grips a section of the pivot holding device. The holding bracket is designed to be elastic and/or compliant with regard to the opening angle of the two bracket ends, so that the clamping means are formed by the holding bracket. This has the advantage that the clamping means are arranged on the sighting telescope, and thus when the elastic properties decrease, they can be replaced more easily. The elasticity can for example be achieved by an extended recess, which is inserted into an area between the bracket ends, and which has larger dimensions than would be necessary for the pivot for reasons relating to the interfering contour.

With this embodiment, it is furthermore preferred that the pivot area be defined by a support point of one of the bracket sections on the pivot holding device. One preferred embodiment provides that the support point between the bracket end which is adjacent to the sighting telescope and a surface of the pivot holding device which faces the sighting telescope is preferably formed on the upper side of the pivot holding device. Another embodiment provides that the support point between the bracket end which is at a distance from the sighting telescope and a surface of the pivot holding device which faces the sighting telescope is preferably formed on the floor surface of the pivot holding device.

With one possible supplement to the invention, the sighting telescope mounting system comprises the arresting foot, wherein the arresting foot is designed as a fixed bearing in the transverse direction, and as a loose bearing in the axial direction.

With one possible further development of the invention, the arresting foot is designed in such a manner that it can be arrested in different angle positions around at least one pivot axis relative to the firearm. The arresting foot is thus angle tolerant, and can thus also be used without subsequent correction when the pivot foot and the arresting foot are not arranged in alignment or twisted towards each other. In particular, the arresting foot permits a secure arrest, even with deviations with regard to a pitch, yaw and/or roll angle of the arresting foot. Particularly preferred are angle tolerances of at least 0.01°, preferably at least 0.1° and in particular of at least 0.4°.

Further features, advantages or effects of the invention will be disclosed in the description of preferred exemplary embodiments of the invention below.

DETAILED DESCRIPTION OF THE INVENTION

Figure 1A:
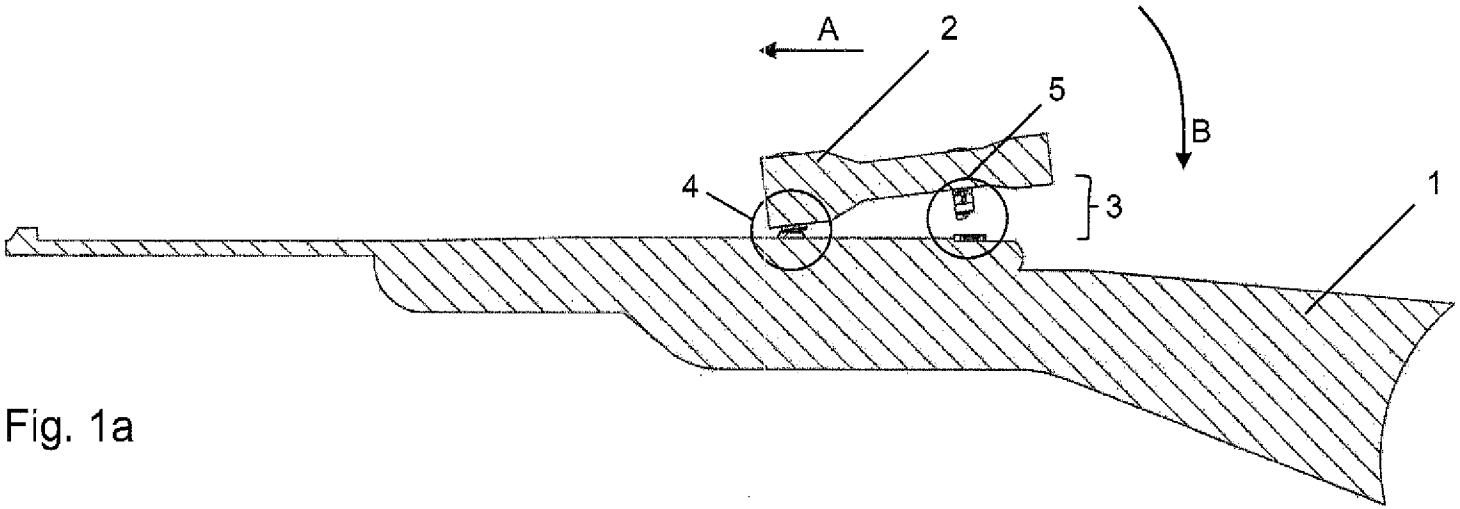
FIGS. 1*a, b* show a side view of a sighting telescope mount on a firearm as an exemplary embodiment of the invention

The same parts, or parts which correspond to each other, are respectively assigned corresponding or the same reference numerals.

Figure 1B:
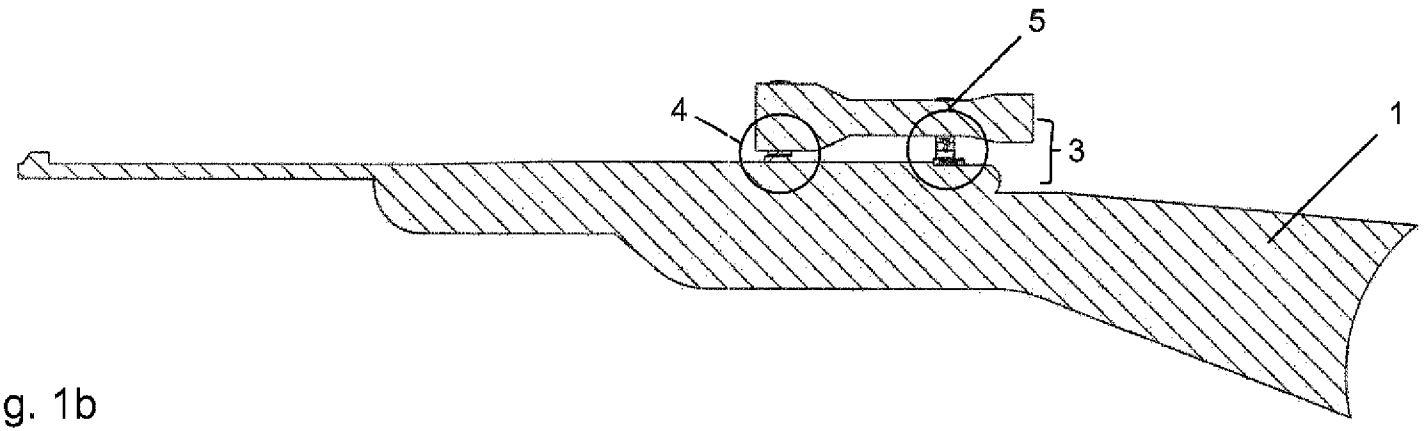

FIGS. 1*a* and 1*b* show in a schematic cross-section view a firearm 1 which is designed as a hunting weapon, to which a sighting telescope 2 is mounted. In order to couple the sighting telescope 2 to the firearm 1, a sighting telescope mounting system 3 is provided which comprises a front attachment area 4 and a rear attachment area 5. During the mounting procedure, the sighting telescope 2 is first hooked in the direction of the arrow A in the front attachment area 4, and then pivoted by a pivot angle using a pivot movement around the front attachment area 4 according to arrow B, so that the rear attachment area 5 is arrested. The pivot is here conducted on the sheet plane in FIGS. 1*a, b*, on which both the axial extension of the firearm 1 and the axial extension of the sighting telescope 2 lies.

Figure 2A:
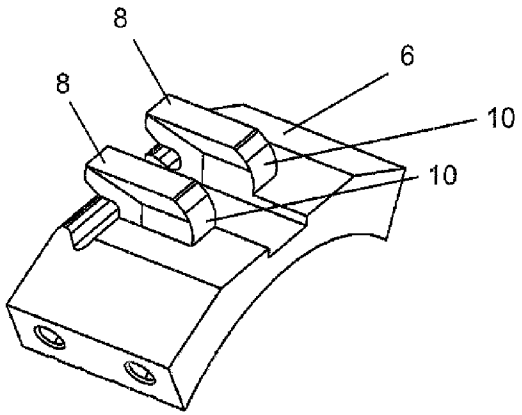
FIG. 2*a* shows the pivot foot of the sighting telescope mounting system in FIGS. 1*a, b*

In FIGS. 2*a, b* and 3, individual parts of the front attachment area 4 are shown respectively in a schematic three-dimensional view.

Figure 2B:
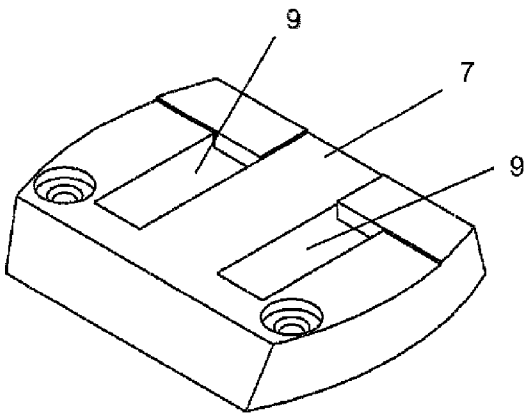
FIG. 2*b* shows the pivot holding device on the firearm of the sighting telescope mounting system shown in FIGS. 1*a, b*

FIG. 2*a* shows a pivot foot 6 which is affixed to the sighting telescope 2; FIG. 2*b* shows a pivot holding device 7 in the form of a mounting plate which is affixed on the firearm 1 by a dovetail guide and/or using screws. The pivot foot 6 is designed as a ring segment and comprises two hooks 8 which are arranged at a distance from each other and which can be inserted into corresponding slits 9 of the pivot holding device 7. During the mounting procedure, the hooks 8 are inserted and hooked in, and thus form a pivot joint together with the pivot holding device 7, which permits the sighting telescope 2 to be pivoted in the direction of the arrow B. The hooks 8 are oriented away from the rear attachment area 5 during mounting. On the side facing towards the rear attachment area 5, the hooks 8 respectively bear a clamping surface 10 which enables an affixing and clamping of the pivot foot 6, and thus of the sighting telescope 2 in the axial direction. The function of the clamping surface 10 will be explained below. The side surfaces of the hooks 8 which are oriented in the direction of revolution around the sighting telescope 2 are retained superficially and with a precise fit, so that a total of four, or at least two, guide surfaces are formed by the side surfaces. The position of the pivot foot 6 is affixed in the transverse direction to the axial direction via the side surfaces.

Figure 3:
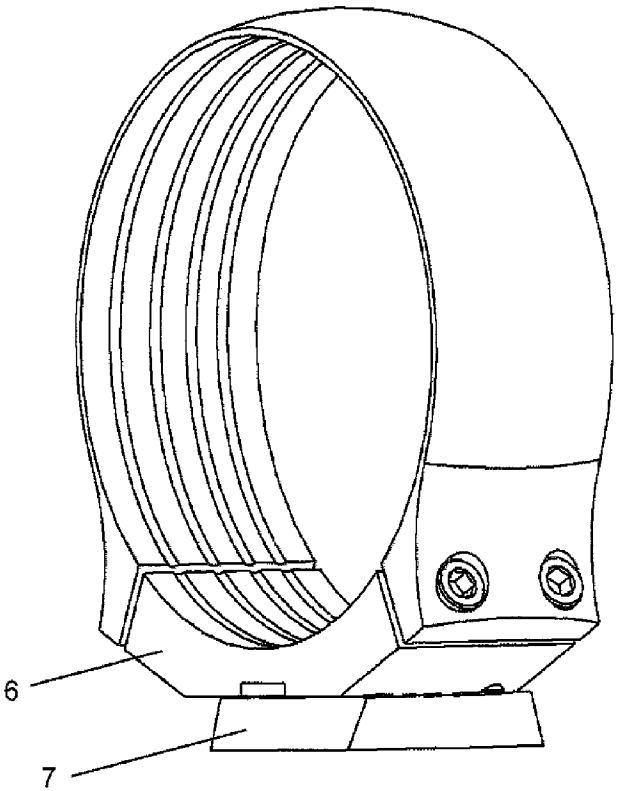
FIG. 3 shows the front holding device of the mounting system in FIGS. 1*a, b*

FIG. 3 shows in a schematic three-dimensional view the front attachment area 4 of the sighting telescope mounting system 3 with a firearm 1 and sighting telescope 2 which are not shown in the drawing. The pivot foot 6 is here hooked into the pivot holding device 7 and brought into the desired position. In order to hold the sighting telescope 2, a metal grip is bolted on in the direction of revolution, which together with the pivot foot 6 forms a mechanical holding device for the sighting telescope 2. With other embodiments, the sighting telescope 2 can also comprise a track which is aligned in the direction of travel, wherein the pivot foot 6 is affixed to the track.

In FIGS. 4, 5, 6, and 7, different embodiments of the invention are shown respectively in a longitudinal section through one of the hooks 8. The views show both variations of the hooking-in mechanism and of the clamping surface 10, wherein further exemplary embodiments are disclosed by any combination required of these variations.

Figure 4:
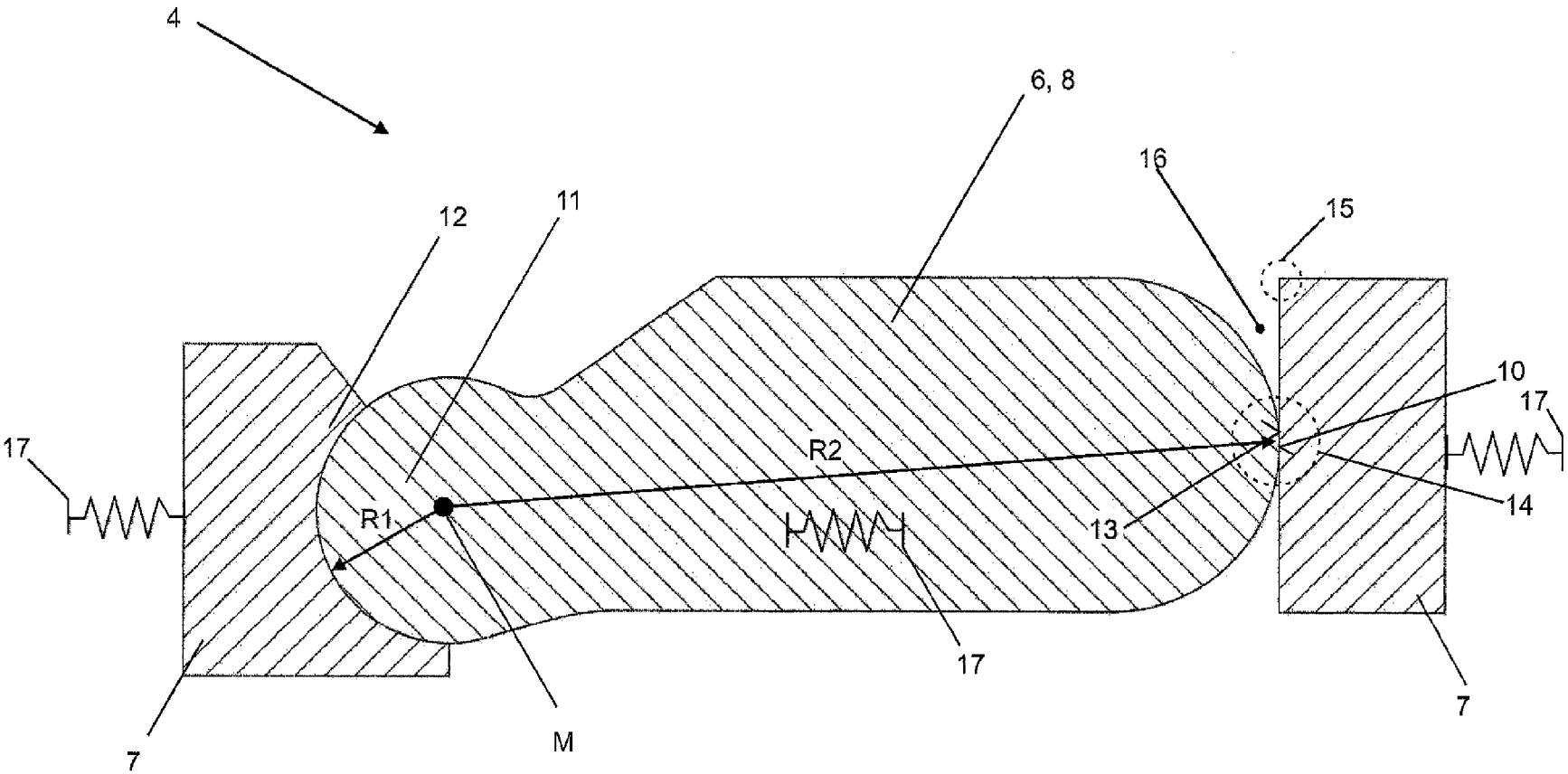
FIG. 4 shows a schematic longitudinal view in the area of the pivot foot of the sighting telescope mounting system as a first possible embodiment of the invention

FIG. 4 shows a hook 8 which for the purpose of hooking in comprises in the longitudinal section shown a hook head 11 with a circle segment form and a radius R1 as a hook 8, which grips into a bearing position 12 of the pivot holding device 7 which is designed correspondingly to it, and is there supported in such a manner that it can be pivoted around the central point M of the hook head 11, so that the sighting telescope 2 can conduct the pivot according to the arrow B shown in FIG. 1. The bearing position 12 can also be formed by just two support areas, instead of the complementary, concave form shown here. The clamping surface 10 of the hook 8 is in contact with a radially aligned connection surface 13 in a contact area 14.

FIG. 4 shows the desired position of the pivot foot 6 and thus of the sighting telescope 2. In this desired position, the contact area 14 is at a distance from an edge area 15 the connection surface 13. As an example, the distance is greater than 0.5 mm, preferably greater than 1 mm and specifically greater than 1.5 mm. With one variation of the pivot angle around the desired position, the contact area 14 remains continuously at a distance from the edge area 15. In particular, a gap 16 extends in the radial direction, which is formed by the clamping surface 10 and the connection surface 13, and which opens steadily starting from the contact area 14.

Due to the remaining area of the connection surface 13 between the contact area 14 and the edge area 15, an abrasion of the edge area 15 is avoided, so that with the mounting system 3 frequent assembly and removal of the sighting telescope 2 is possible without overhauling the mounting system 3. If in the exemplary embodiment shown, the radius R2 of the clamping surface 10 is selected in such a manner that it corresponds to the distance between the contact area 14 and the centre of rotation M, and additionally, the same radius is used for the curvature, the contact area 14 does not move at all with slight variations of the pivot angle, e.g. of less than 1° or less than 0.5°.

Similar effects can also be attained, however, when the clamping surface 10 is designed to be level, and by contrast, the connection surface 13 is curved. Both surfaces can also be curved, wherein on the one hand, a curvature in opposite directions and on the other, a curvature in the same direction with different degrees of curvature is possible. All these exemplary embodiments can be designed in such a manner that the contact area 14 is at a safe distance from the edge area 15 when in the desired position, and that it has a certain angle tolerance with regard to the pivot angle.

In order to achieve a pre-tensioning in the axial direction or a clamp in the axial direction, clamping means 17 can be provided which on the one hand press the connection surface 13 in the direction of the hook 8, and on the other hand press the bearing position 12 in the direction of the hook 8 and/or which are arranged in the hook 8 and rest in the axial direction against the bearing position 12 and the connection surface 13.

Figure 5:
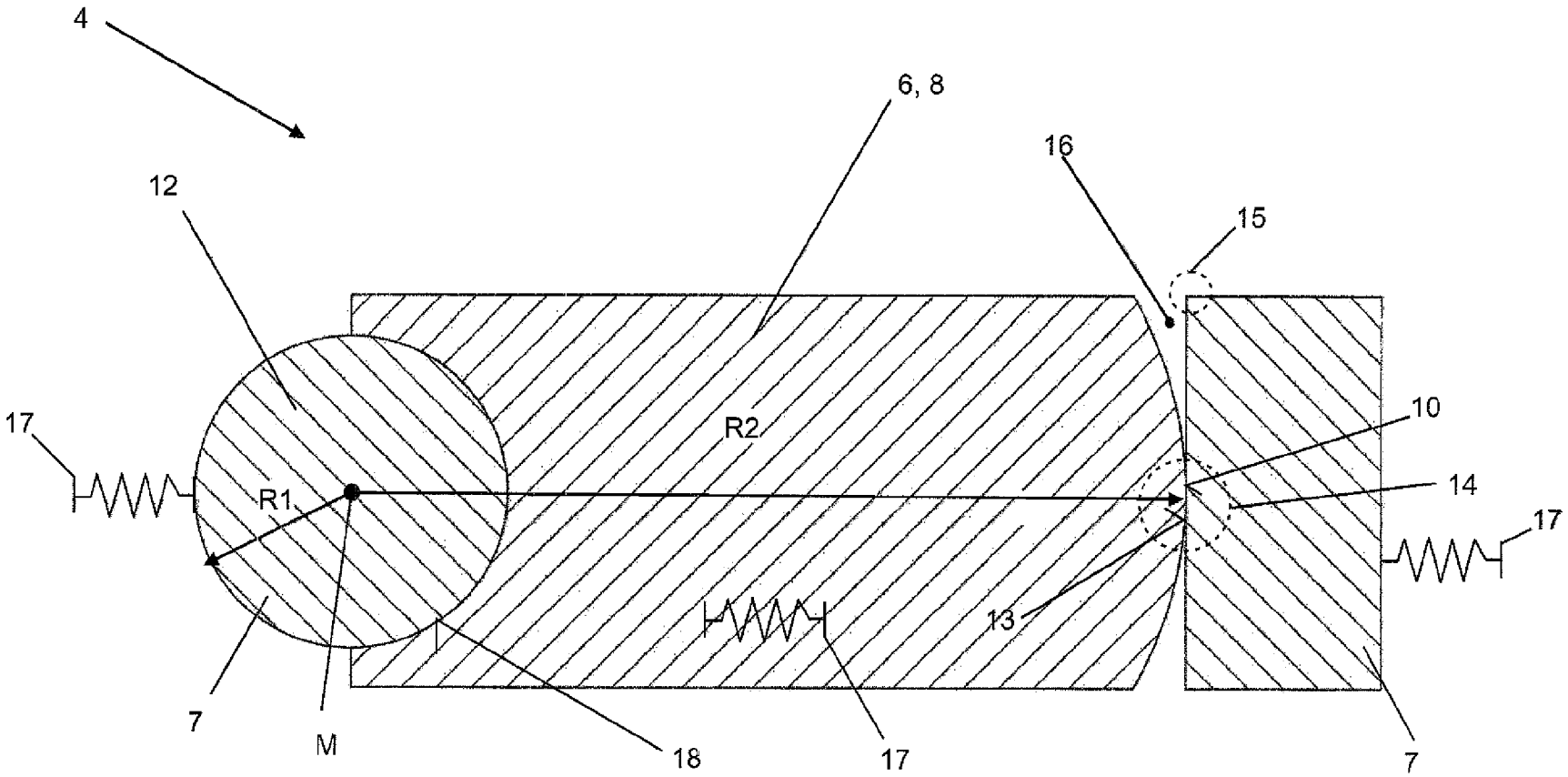
FIG. 5 shows in a similar view as FIG. 4 a second embodiment of the invention

FIG. 5 shows a second exemplary embodiment of the invention which essentially differs from the exemplary embodiment shown in FIG. 4 due to the fact that the bearing position 12 is designed as a pin, which can for example be hardened and ground, and which is designed as part of the pivot holding device 7. In this case, the hook 8 comprises a pin holding device 18, so that the hook 8 can pivot around the central point M which is now located in the centre of the pin. Here, the individual areas can also be equipped with clamping means 17. The pin holding device 18 can in the cross-section view shown also be designed as a V-shaped holding device. It can also be sufficient for components to be restricted to the functional surfaces, so that instead of a pin, a cylindrical section or even only several cylinder barrel surface sections are used as a bearing position.

Figure 6:
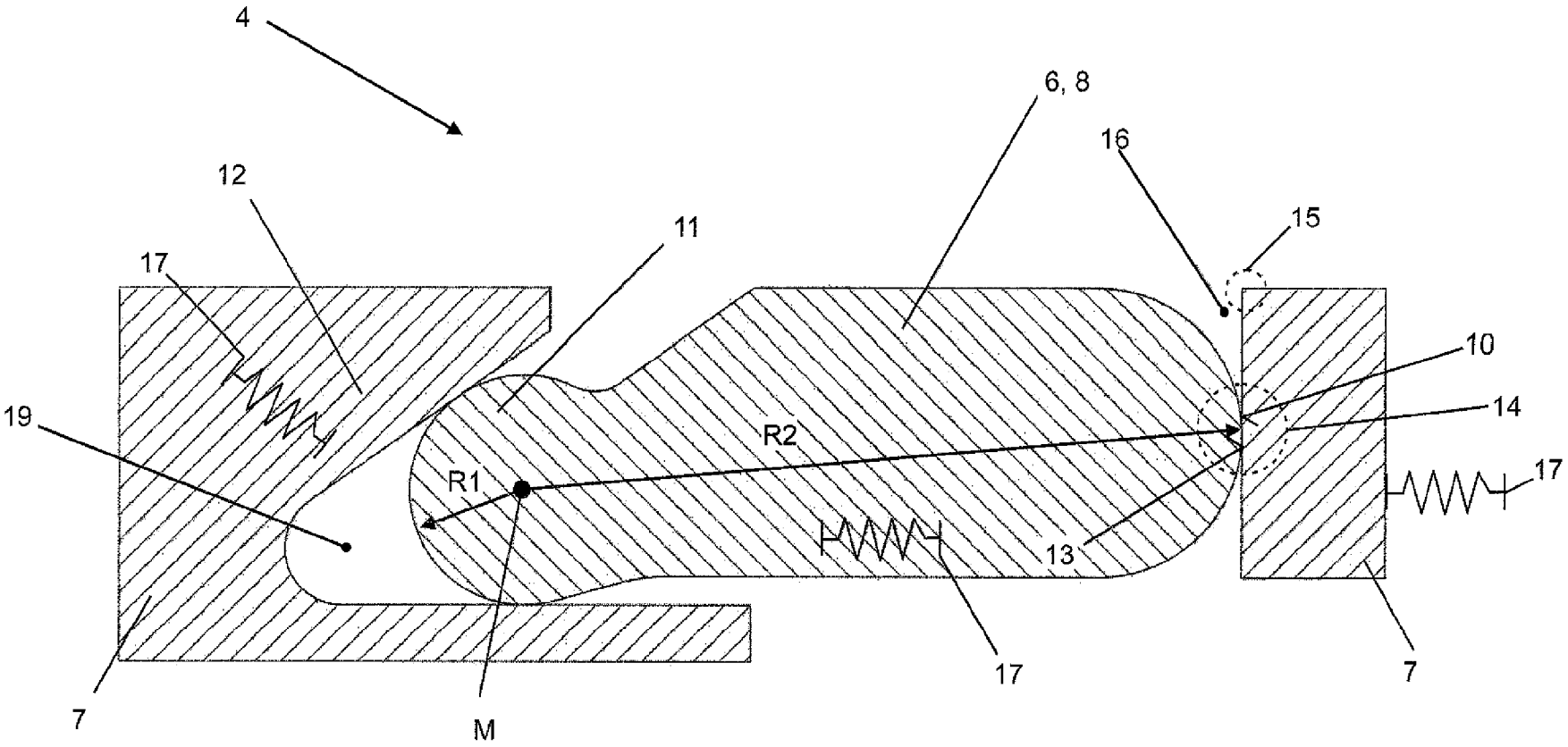
FIG. 6 shows in the same view as FIGS. 4 and 5 a third embodiment of the invention

FIG. 6 shows a third exemplary embodiment of the invention, wherein the hook 8 is designed in a similar manner to the embodiment shown in FIG. 4, so that a reference is made to the description there. The pivot holding device 7 is however realised in a different manner. Here, a jaw 19 is formed to hold the hook head 11, which guides the hook head 11 during the pivot movement. The jaw 19 can be designed to be elastic within certain limits, so that when subjected to a load in the axial direction, it can expand through the hook head 11, thus forming the clamping means 17. As an alternative or a supplement to this, further clamping means can again be provided.

Figure 7:
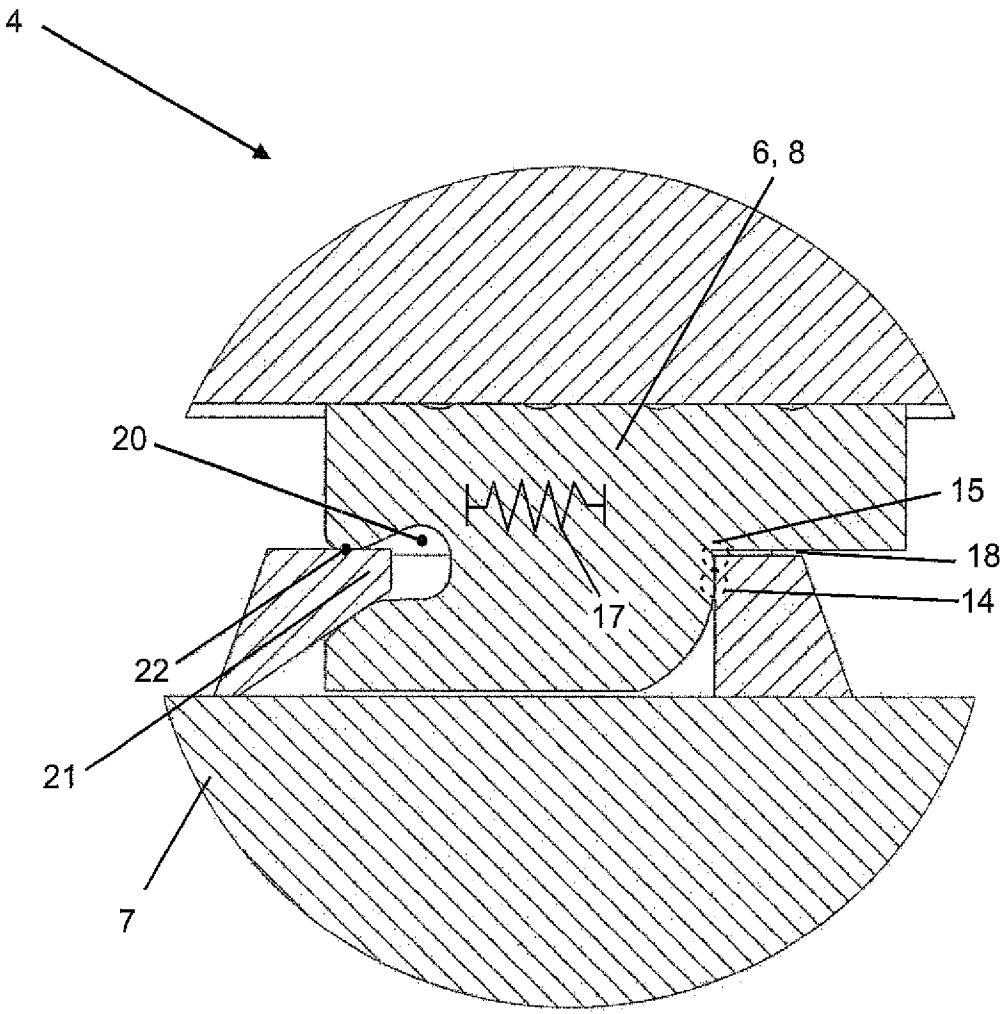
FIG. 7 shows in the same view as the preceding figures a fourth embodiment of the invention

FIG. 7 shows a next embodiment of the invention, wherein the hook 8 comprises a hook jaw 20 which grips a stationary area 21 of the pivot holding device 7. The hook jaw 20 lies with a support area 22 on an upper side of the stationary area 21, wherein the support area 22 at the same time forms a pivot point or a pivot area for the pivot movement of the pivot foot 6 or the sighting telescope 3. Here also, the hook jaw 20 and the stationary area 21 are designed in such a manner that clamping means 17 are formed, which implements a pre-tensioning of the hook 8 in the axial direction against the connection surface 13. In the exemplary embodiment shown, the contact area 14 has slipped closer to the edge area 15 in the desired position; however, the gap 16 remains, so that the sensitive edge area 15 is not subjected to stress and cannot be abraded. In the detailed view, this area is thus designed in the same manner as is shown in the preceding figures. It should also be noted that between the pivot foot 6 and the pivot holding device 7, in an area adjacent to the edge area 15, a gap 18 which runs in the transverse direction is formed, so that from the desired position, the pivot foot 6 can be moved in a swing-open direction as well as in a closing direction without a mechanical end stop.

All the exemplary embodiments shown share the feature that even with a moderate variation of the pivot angle of e.g. less than 1°, in particular less than 0.5°, the contact area 14 remains at a distance from the edge area 15, so that different positions can also be set alongside the desired position with low-level abrasion or no abrasion at all. Due to the clamping means 17, the force required for the pivot is almost constant in the named pivot angle range. Furthermore, the pivot foot 6 is arranged as a clamp in such a manner that the sighting telescope 2 is self-retaining in the pivot angle ranges. In particular, the pre-tensioning force is also constant, or near-constant, between the clamping surface 10 and the connection surface 13 within the above-named pivot angle range, i.e. with a maximum deviation of 20% of the pre-tensioning force in the desired position.

In conceptional terms, the front area 4 implements a fixed bearing in the axial direction and in the transverse direction, and forms a loose bearing for the pivot angle. By contrast, the rear area 5 is designed as a fixed bearing in the transverse direction and upwards so that the pivot angle is defined, and is realised as a loose bearing in the axial direction. In particular, the sighting telescope 2 is kept tension-free by the mounting system 3.

LIST OF REFERENCE NUMERALS

1 Firearm
2 Sighting telescope
3 Sighting telescope mounting system
4 Front attachment area
5 Rear attachment area
6 Pivot foot
7 Pivot holding device
8 Hook
9 Slits
10 Clamping surface
11 Hook head
12 Bearing position
13 Connection surface
14 Contact area
15 Edge area
16 Gap
17 Clamping means

18 Gap
19 Jaw
20 Hook jaw
21 Stationary area
22 Support area

The invention claimed is:

1. A sighting telescope mounting system for a firearm for mounting a sighting telescope onto the firearm in a desired position, wherein the firearm and/or the sighting telescope are aligned in the desired position in an axial direction, the mounting system comprising:

a pivot foot attachable to one of a sighting telescope and a firearm;

a pivot holding device affixable to the other of the sighting telescope and the firearm, wherein the pivot foot and the pivot holding device together form a pivot joint, which during mounting enables the sighting telescope to pivot by a pivot angle around a pivot range on a plane which is formed by the sighting telescope and an axial direction of the firearm;

a connection surface arranged on the pivot holding device; and a clamping surface arranged on the pivot foot that, when mounted, forms a contact area with the connection surface, so that the pivot foot is affixed in the axial direction, wherein in a desired position, the contact area is arranged in a radial alignment and/or at a distance from an edge of the connection surface towards the sighting telescope, wherein a pivot force and/or a pre-tensioning force between the connection surface and the clamping surface is substantially constant in a pivot angle range around the desired position.

2. The sighting telescope mounting system according to claim 1, wherein, in the desired position, a radially outwardly opening gap is formed between the connection surface and the clamping surface, starting from the contact area.

3. The sighting telescope mounting system according to claim 2, wherein the connection surface and/or the clamping surface is or are curved in a longitudinal section through the sighting telescope mounting system, so as to form the opening gap.

4. The sighting telescope mounting system according to claim 1, further comprising a press applying a clamping force to the pivot foot in the axial direction.

5. The sighting telescope mounting system according to claim 1, wherein the pivot range is formed by a support point or area of the pivot foot on the pivot holding device and/or by a center of rotation.

6. The sighting telescope mounting system according to claim 1, wherein the pivot holding device is a mounting plate which can be inserted into a dovetail guide of the firearm.

7. The sighting telescope mounting system according to claim 1, wherein the pivot foot comprises a hook section which enables a claw mount in the pivot holding device.

8. The sighting telescope mounting system according to claim 7, wherein the pivot foot comprises two hook sections which are arranged at a distance from each other.

9. The sighting telescope mounting system according to claim 8, wherein the hook sections form a part of the pivot joint.

10. The sighting telescope mounting system according to claim 1, wherein the pivot foot and/or the pivot holding device comprises, in a longitudinal section, a circle segment contour that forms a part of the pivot joint.

11. The sighting telescope mounting system according to claim 4, wherein the pivot foot comprises a holding bracket that grips a section of the pivot holding device.

12. The sighting telescope mounting system according to claim 11, wherein the gripped section of the pivot holding device is a pin.

13. The sighting telescope mounting system according to claim 11, wherein the gripped section is a section that is arranged as a single piece in the pivot holding device.

14. The sighting telescope mounting system according to claim 11, wherein the holding bracket forms the damping means.

15. The sighting telescope mounting system according to claim 11, wherein the pivot range is defined by the support point of an end of the holding bracket.

16. The sighting telescope mounting system according to claim 1, further comprising an arresting foot formed as a fixed bearing in a transverse direction and upwards so that the pivot angle is defined, and as a loose bearing in the axial direction.

17. The sighting telescope mounting system according to claim 16, wherein the arresting foot is arrestable in different angle positions around at least one pivot axis relative to the firearm.

* * * * *